US007592751B2

(12) United States Patent
Nakamura

(10) Patent No.: US 7,592,751 B2
(45) Date of Patent: Sep. 22, 2009

(54) EXCIMER LAMP AND ULTRAVIOLET-RAYS IRRADIATION APPARATUS HAVING THE SAME

(75) Inventor: Masaki Nakamura, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 516 days.

(21) Appl. No.: 11/588,288

(22) Filed: Oct. 27, 2006

(65) Prior Publication Data

US 2007/0149086 A1 Jun. 28, 2007

(30) Foreign Application Priority Data

Oct. 28, 2005 (JP) ..... 2005-314033

(51) Int. Cl.
*H01J 17/16* (2006.01)

(52) U.S. Cl. ..... 313/634; 313/593

(58) Field of Classification Search ..... 313/493, 313/634–637

See application file for complete search history.

(56) References Cited

U.S. PATENT DOCUMENTS 6,693,397 B2 2/2004 Handa et al.

FOREIGN PATENT DOCUMENTS

JP 2003-068478 A 3/2003
JP 2005-100934 A 4/2005
JP 2008269976 A * 11/2008

* cited by examiner

*Primary Examiner*—Vip Patel
(74) *Attorney, Agent, or Firm*—Rader, Fishman & Grauer, PLLC

(57) ABSTRACT

An excimer lamp has an arc tube made of dielectric materials capable of transmitting ultraviolet rays, a pair of electrodes facing each other through the dielectric materials forming the arc tube, and a high voltage power supply terminal for supplying high voltage to the electrodes through a high voltage power supply cable, the excimer lamp. The excimer lamp further has an insulated holder provided in the high voltage power supply terminal, wherein the insulated holder has an inner space and the high voltage power supply cable connected to a connector for electric supply is inserted in the insulated holder, and an IC tag, wherein a gap is provided between the high voltage power supply cable and the IC tag.

18 Claims, 9 Drawing Sheets

EXCIMER LAMP AND ULTRAVIOLET-RAYS IRRADIATION APPARATUS HAVING THE SAME

CROSS-REFERENCES TO RELATED APPLICATION

This application claims priority from Japanese Patent Application Serial No. 2005-314033 filed on Oct. 28, 2005, the contents of which are incorporated herein by reference in its entirety.

TECHNICAL FIELD

Described herein is an excimer lamp and an excimer light emitting apparatus which are used as a light source for dry washing (UV/$O_3$ washing), before carrying out an LCD or semiconductor manufacturing process etc.

BACKGROUND

A UV/$O_3$ cleaning method is widely used as a washing method in which ultraviolet rays and ozone ($O_3$) which is an oxygen radical kind are used together. For example, molecular bonds of, for example, an organic compound adhering to a surface of a substrate for an LCD, or a semiconductor substrate are cut by emitting ultraviolet rays to the surface, so that impurities, such as an adhering organic compound can be removed.

In recent years, as a light source used for the UV/$O_3$ cleaning method, instead of a conventional low-pressure mercury lamp which emits ultraviolet rays having wavelengths of 185 nm and 254 nm, an excimer lamp is used in which, for example, xenon gas is used as a light-emitting material so that a vacuum-ultraviolet light with a wavelength of 172 nm may be emitted, and the washing capacity thereof is superior to that of a low-pressure mercury lamp.

FIG. 7 is a cross-sectional view of a conventional ultraviolet-ray emitting apparatus in which an excimer lamp is installed, and FIG. 8 is a cross-sectional view of an ultraviolet-ray emitting apparatus taken along a line VIII-VIII of FIG. 7. Moreover, FIG. 9 is an enlarged cross-sectional view of the dotted line portion IX of FIG. 8. In addition, a connector shown in FIG. 8 is omitted in FIG. 7.

An ultraviolet-ray emitting apparatus has a metal case 10 in which inert gas is circulated through a gas introducing port 10*b* and a gas exhaust port 10*c* which are provided in side surfaces of the case. A plurality of excimer lamps 1 are disposed inside the case 10, in which tube axes are in parallel to each other. A gutter-like reflection mirror 2 which reflects ultraviolet rays emitted from the excimer lamp 1 toward a work piece is disposed corresponding to each excimer lamp 1. Each excimer lamp 1 for which the reflection mirror 2 is fixed to a cooling block 3 made of aluminum, in which a water-cooled pipe is piped throughout the interior.

Such an excimer lamp 1 is shown in Japanese Laid Open Patent No. 2005-100934. As shown in FIG. 8, sealing portions 1*f* are formed at both ends of an arc tube 1*a* made from dielectric material which transmits vacuum-ultraviolet light, by pinch-sealing the both ends, in each of which a metallic foil 1*e* is buried. Inside the arc tube 1*a*, while a coil-like internal electrode 1*b*, both ends of which are connected to the respective metallic foils 1*e*, is arranged on the tube axis of the arc tube 1*a*, the circumference of the internal electrode 1*b* is covered with an insulator 1*d*. Moreover, on an outer surface of the arc tube 1*a*, a mesh-like external electrode 1*c* is arranged. An external lead 1*g* which projects toward the outside of the arc tube 1*a* is connected to each metallic foil 1*e*. A high voltage power supply cable 12*c* is connected to one of the external leads 1*g*, in which a high voltage power supply terminal 12 is provided at an end portion thereof (Refer to FIG. 9).

As shown in FIG. 9, a high voltage power supply terminal 12 comprises a plug 12*a* to which the electric supply cable 12*c* is connected, and an insulated holder 12*b*, in which the electric supply cable 12*c* is inserted. The tip of the plug 12*a* connected to the electric supply cable 12*c* projects toward the outside from the insulated holder 12*b*, and the electric supply cable 12*c*, the insulated holder 12*b*, and plug 12*a* are integrally formed. The internal electrode 1*b* and a high-frequency lighting power supply (not shown) are electrically conducted (connected) by inserting the plug 12*a* in the connector 11 whose casing is made of resin, which is attached to the outer wall of the case 10. Although the external electrode 1*c* is not illustrated, the electrode 1*c* is electrically conducted (connected) with the high frequency lighting power supply similarly the internal electrode.

If the above excimer lamp reaches the end of life span thereof, the intensity of radiation of vacuum ultraviolet radiation decrease as the quartz glass etc. forming the arc tube is deteriorated. Therefore, although it is necessary to replace it with a new one, it is in general difficult to determine whether it reached the end of the life span from the appearance of the excimer lamp. Thus, there is a demand that integral lighting time information be added to each excimer lamp. Moreover, if the physical-property information of each excimer lamp etc. is given in addition to the integral lighting time information, it is advantageous when lighting of a lamp is controlled.

Here, the lamp physical-property information includes but is not limited to information of the light intensity property, that is, information that the luminance is 1 lm (lumen) per 100 W of input power at a portion downwardly apart by 10 mm from the arc tube, or load property information, that is, information that unusual electric discharge does not take place when the input power is less than 100 W.

Here, Japanese Laid Open Patent No. 2003-68478 discloses the technology of making each lamp have integral lighting time information in the light source apparatus used for an endoscope etc. in order to know the end of the life span of the lamp.

According to this light source apparatus, since the integral lighting time information which is updated up to the last usage is stored in an IC tag (comprising such as a chip or an integrated circuit) attached to the lamp unit, when the light is turned on, the integral lighting time information can be updated to the latest information as needed by updating and storing the integral lighting time information in the IC tag. Therefore, if the IC tag is attached to each excimer lamp shown in FIG. 7, it is possible to give integral lighting time information to each excimer lamp, and to predict certainly the end of life span of each excimer lamp.

SUMMARY

Since in the above-mentioned excimer lamp, discharge is caused by applying a high voltage, and 90% or more of electric discharge energy is changed into heat, the temperature of the outer surface of the arc tube becomes extremely high at the time of lighting. And when an IC tag is attached to the outer surface of such an arc tube, the temperature of the IC tag becomes superfluously high, whereby a function for storing desired information will be lost.

Therefore, as disclosed in Japanese Laid Open Patent No. 2003-68478, it seems that it is possible to prevent the temperature of the IC tag from becoming high by attaching the IC tag to a surface of a lamp bracket which holds the lamp.

However, such a structure cannot be applied to an ultraviolet-ray emitting apparatus shown in the FIGS. 7 and 8.

Moreover, in Japanese Laid Open Patent No. 2003-68478, since the lamp and IC tag are not integrally formed, when it is necessary to replace the lamp, the IC tag is necessarily replaced together with the new lamp, since there will be a problem that the old lamp information stored in the IC tag does not mach with information of the new lamp if the IC tag is not replaced together with the lamp.

In addition, as mentioned above, since such an excimer lamp becomes extremely high temperature at the time of lighting, the lamp is installed in a metal case in which a water-cooled block is built as shown in FIG. 7.

On the other hand, when an IC tag is installed, it is necessary to provide an antenna for transmission and reception of data near the IC tag. However, where there is such a metallic case between the IC tag and the antenna, a problem may occur in transmission and reception of data. Therefore, it is necessary to take into consideration mutual attachment positions of the IC tag and the antenna so that the data may be transmitted and received between the IC tag and the antenna.

Furthermore, in order to cause discharge in an excimer lamp, it is necessary to impress a high frequency/high voltage to electrodes through a high voltage power supply terminal by high-frequency lighting power supply. For this reason, a strong electric field is generated around the electric supply cable of the excimer lamp. Therefore, depending on the installation position of the IC tag, the strong electric field is applied to the IC tag, so that the IC tag may be broken down by electromotive force generated in the IC tag, or the IC tag malfunctions by a noise.

Although, as mentioned above, there is a demand that an IC tag be installed, corresponding to each excimer lamp, there are various problems that the IC tag cannot be attached to the arc tube of the excimer lamp since it becomes high temperature during lighting, that there is a possibility that the high frequency/high voltage impressed to an excimer lamp may have a bad influence on the IC tag, and that a determination of the installation positions of the antenna which transmits and receives data with the IC tag is difficult, etc. Therefore, it is necessary to solve these problems in order to install the IC tags according to individual excimer lamps.

In view of the above problem, in the present excimer lamp and the present ultraviolet ray emitting apparatus, it is possible to install an IC tag capable of storing various information according to individual excimer lamps, and the IC tag is not affected by the high frequency/high voltage applied to the excimer lamp while there is no problem in communication between the IC tag and an antenna.

As mentioned above, an IC tag cannot be provided on the outer surface of an arc tube of an excimer lamp. Therefore, the present inventor examined measures from the above stand point, and discovered that it is preferred that the IC tag may be installed in a high voltage power supply terminal in an insulated holder whose temperature is much lower than that of the outer surface of an arc tube. However, in order to cause discharge in an excimer lamp, it is necessary to impress the high voltage to electrodes through a high voltage power supply terminal by high-frequency lighting power supply. In such a case, when a strong electric field occurs around an electric supply cable inserted into an insulated holder, the strong electric is built against the IC tag, so that electromotive force arises in the IC tag, and the problem that IC tag breaks occur. Moreover, there is also a problem that transmission and reception of data is not necessarily performed between an antenna and IC tag.

The above-mentioned problems are solved as set forth below.

(1) The present excimer lamp has an arc tube made of dielectric materials capable of transmitting ultraviolet rays, has a pair of electrodes facing each other through the dielectric materials forming the arc tube, and a high voltage power supply terminal for supplying high voltage to the electrodes through a high voltage power supply cable, the excimer lamp, in which electric discharge material is filled up with in its inner space. The excimer lamp includes an insulated holder provided in the high voltage power supply terminal, wherein the insulated holder has an inner space and the high voltage power supply cable connected to a connector for electric supply is inserted in the insulated holder, and an IC tag, wherein a gap is provided between the high voltage power supply cable and the IC tag. Thus, since the insulated holder in which the high voltage power supply cable connected to the connector for electric power supply is inserted is provided in the high voltage power supply terminal which is much lower temperature than the outer surface of the arc tube, and further, an inner space was formed in this insulated holder, in which an IC tag for storing the information about the excimer lamp connected to the high voltage power supply terminal is provided in the inner space thereof, the IC tag will not be raised to a high temperature, and the IC tag will not malfunction.

Moreover, since the IC tag is provided in the insulated holder attached to the high voltage power supply cable of the excimer lamp, there is no problem that the information stored in the IC tag does not correspond to the replaced lamp since when the excimer lamp is replaced, the IC tag is also replaced together with the high voltage power supply cable. Furthermore, by arranging the IC tag through a gap between the IC tag and the high voltage power supply cable, the electric field of the circumference of the IC tag become low and the problems of the IC tag breaking and/or malfunctioning can be avoided. Moreover, the IC tag can also be protected from heat generated by surroundings of the electric supply cable.

(2) The excimer lamp may include a high frequency current absorber provided between the high voltage supply cable and the IC tag, and a shield material provided on an IC tag side surface of the high frequency current absorber. Therefore, the high frequency current generated around the high voltage supply cable can be absorbed, so that the IC tag can be protected from the noise caused thereby.

(3) Moreover, when imaginary part ($\mu''$) of complex permeability ($\mu=\mu'-j\mu''$) of the high frequency current absorber into is 1.0 or more, a good high-frequency-current absorption property can be acquired against approximately 600 MHz noise generated from a high voltage power supply cable.

(4) In addition to the shield material, the excimer lamp may have a magnetic sheet which has the high complex permeability with high real part and low imaginary part on the IC tag side of the high frequency current absorber. Therefore, it is possible to perform good communication with the IC tag.

(5) When the insulated holder is made from an insulator having relative permittivity of 4.0 or less, the insulation between the terminal area of the high voltage power supply cable and the case can be fully secured.

(6) In the excimer lamp, the insulated holder may be made of a metal oxide or quartz glass so that the heat insulation effect between the IC tag and the high voltage power supply cable may be improved.

Moreover, the heat insulation effect between IC tag and the high voltage power supply cable can be improved by the insulated holder made from a metal oxide or quartz glass.

(7) An ultraviolet-ray emitting apparatus comprises an excimer lamp having an arc tube made from dielectric material capable of transmission of ultraviolet-ray, a pair of electrodes which face each other through the dielectric material, a high voltage power supply terminal including an insulated holder having an inner space, which supply high voltage to the pair of electrodes through a high voltage power supply cable, wherein the high voltage power supply cable to be connected to a power supply connector is inserted in the high voltage power supply terminal, a metallic case having a light emitting window from which light from the excimer lamp is emitted outside thereof, a connector member which is proved on the case, is made of material capable of transmission of electric wave, and supplies high voltage to the high voltage power supply terminal of the excimer lamp, an IC tag is arranged in the inner space wherein a gap is provided between the high voltage power supply cable and the IC tag; and an antenna which carries out transmission or reception of information with the IC tag.

Therefore, even if the case is made of metal, it is possible to perform communications between the IC tag and the antenna through the connector portion made from material capable of transmitting electric waves, such as resin.

Thus the present invention possesses a number of advantages or purposes, and there is no requirement that every claim directed to that invention be limited to encompass all of the advantages and purposes.

BRIEF DESCRIPTION OF DRAWINGS

Other features and advantages of the present excimer lamp and ultraviolet-rays irradiation apparatus will be apparent from the ensuing description, taken in conjunction with the accompanying drawings, in which.

DETAILED DESCRIPTION

Figure 1:
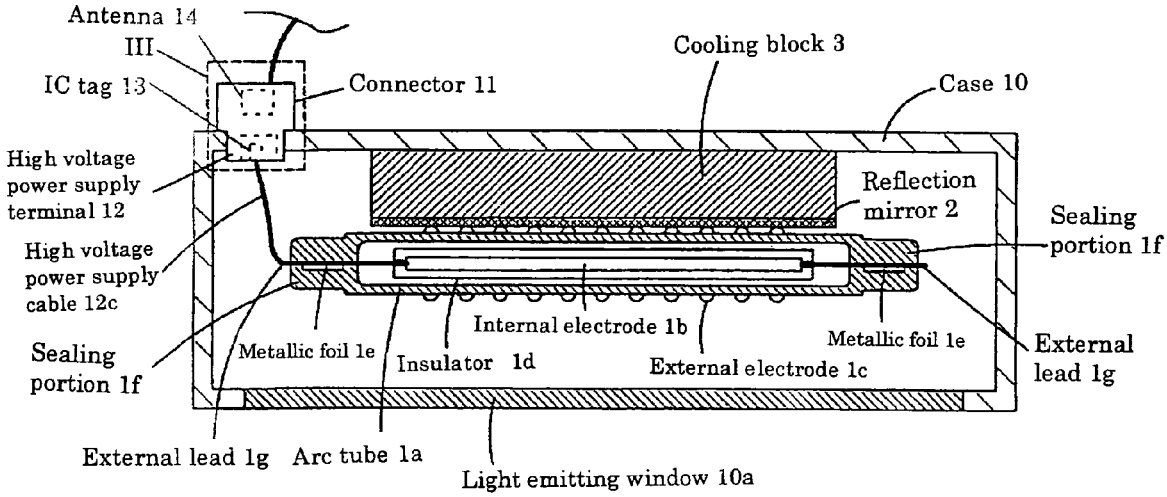
FIG. 1 is a cross-sectional view showing the structure of an ultraviolet ray emitting apparatus according to an embodiment of the present invention.

FIG. 1 is a cross-sectional view of an ultraviolet-ray emitting apparatus having an excimer lamp according to an embodiment of the present invention. FIG. 1 is also a cross-sectional view of the ultraviolet-ray emitting apparatus, taken along a line I-I of FIG. 7. A cross-sectional view of the excimer lamp according to the present embodiment, taken along a plane perpendicular to the tube axis of a lamp is omitted since it is the same as that of FIG. 7.

Figure 7:
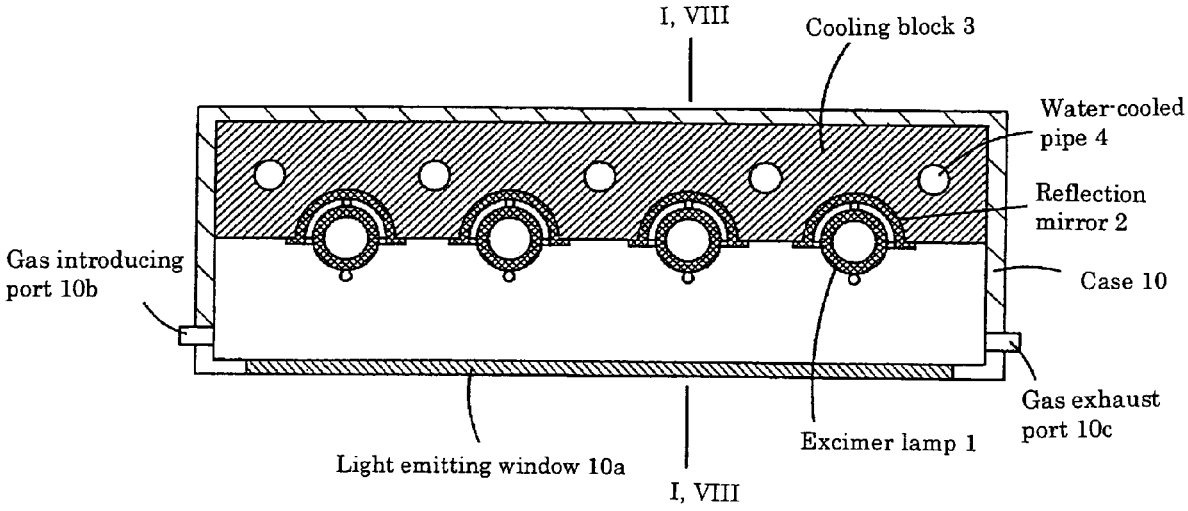
FIG. 7 is a cross-sectional view explaining the conventional ultraviolet ray emitting apparatus in which an excimer lamp is installed.
Figure 8:
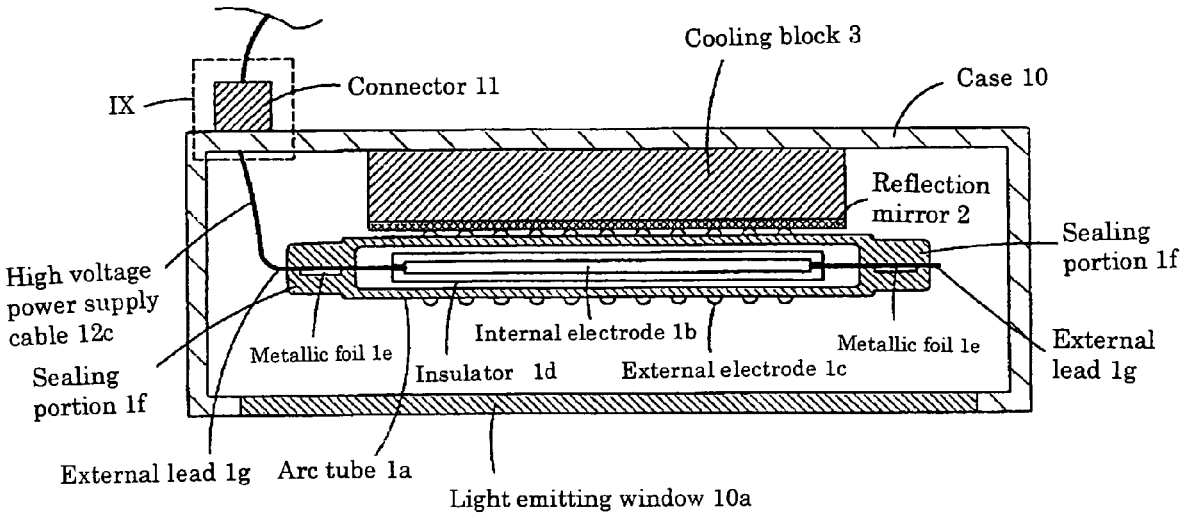
FIG. 8 is a cross-sectional view thereof, taken along a line A-A'.
Figure 9:
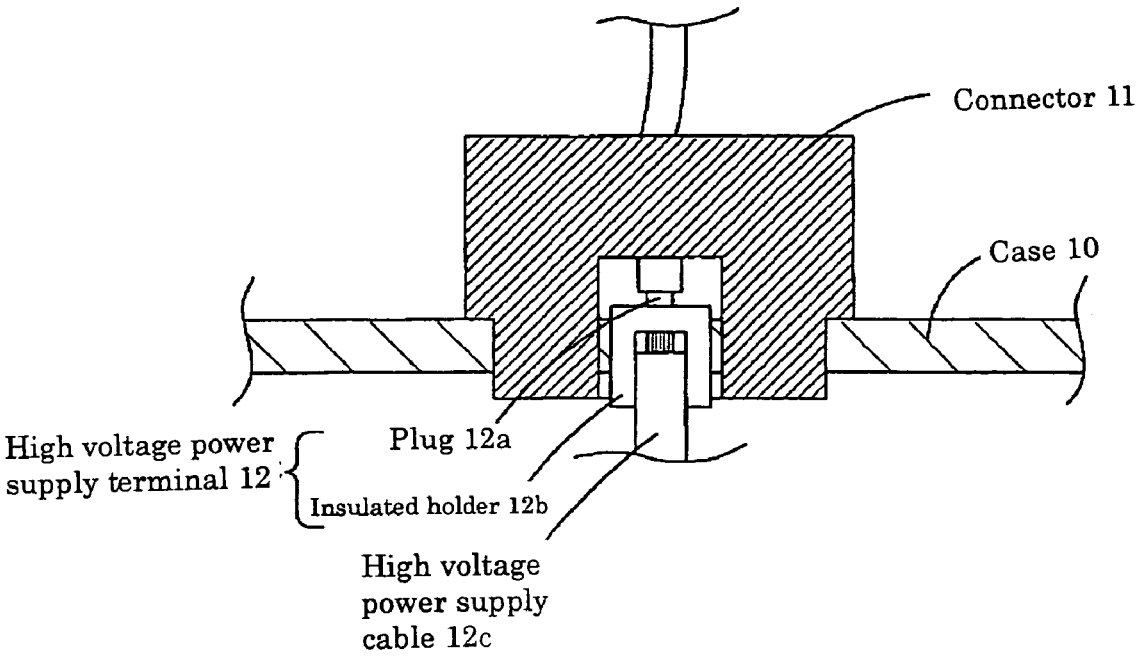
FIG. 9 is an enlarged cross-sectional of a portion IX of FIG. 8.

The ultraviolet-ray emitting apparatus has a metal case 10 therein, in which inert gas is circulated, as described above. As shown in FIG. 7, the two or more excimer lamps 1 are arranged in parallel so that their tube axes are parallel to each other are provided inside the case 10. A gutter-like reflection mirror 2 which reflects ultraviolet rays emitted from the excimer lamp 1 toward a work piece is provided for each of the excimer lamps 1. Each excimer lamp 1 in which the reflection mirror 2 is provided is fixed to a cooling block 3 made of aluminum. In the cooling block 3, a water-cooling pipe is laid so that water is circulated.

In the excimer lamp 1, as shown in FIG. 1 or Japanese Laid Open Patent No. 2005-100934 which is described above, sealing portions if, in each of which a metallic foil 1*e* is buried, are formed at both ends of the arc tube 1*a* made of dielectric material through which vacuum-ultraviolet light is transmitted. Inside the arc tube 1*a*, a coil-like internal electrode 1*b* is arranged on the tube axis of the arc tube 1*a*, and, the circumference of the internal electrode 1*b* is covered with insulator 1*d*. Moreover, a mesh-like external electrode 1*c* is arranged on the outer surface of the arc tube 1*a*. External leads 1*g* which project from the arc tube 1*a* toward the outside thereof are connected to respective metallic foils 1*e*, and a high voltage power supply cable 12*c* is connected to the external lead 1*g*, and a high voltage power supply terminal 12 is provided at an end thereof. The connector 11 made of resin is attached to a case 10, and the antenna 14 is provided in this connector 11.

Moreover, a high voltage power supply terminal 12 is attached to an end portion of the high voltage power supply cable 12*c*, and an IC tag is provided in an insulated holder of the high voltage power supply terminal 12 as described below. By inserting a plug of the high voltage power supply terminal 12 in the connector 11, the internal electrode 1*b* and a high-frequency lighting power supply are electrically connected to each other. Although the connection of the external electrode 1*c* is not illustrated in the figures, the electrode is electrically connected to the high-frequency lighting power supply, as well.

Figure 2:
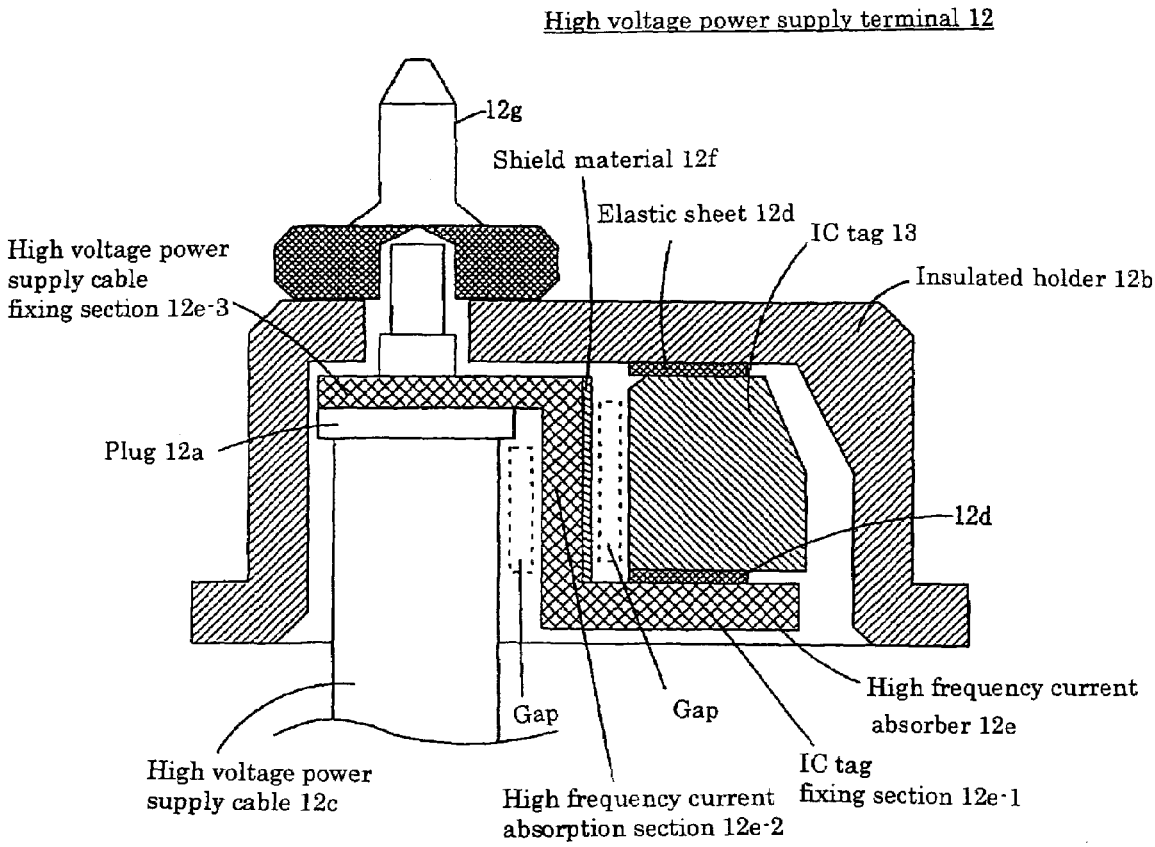
FIG. 2 is an enlarged view of a high voltage power supply terminal of a first embodiment of the present invention.
Figure 3:
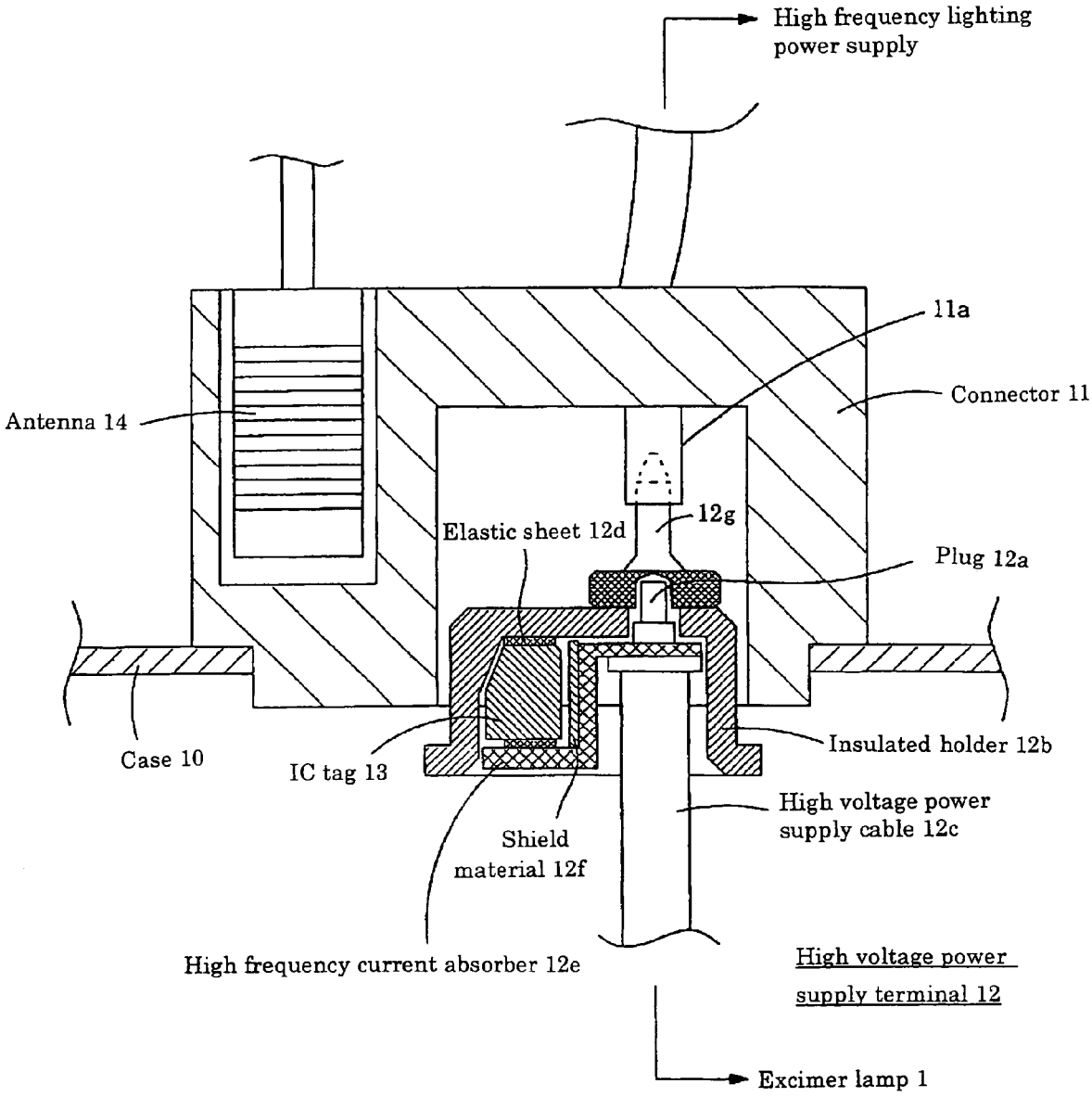
FIG. 3 is a diagram showing the structure of a connecting portion of a high voltage power supply terminal and a connector according to the present invention.

FIG. 2 is an enlarged view of the high voltage power supply terminal according to the first embodiment. FIG. 3 is an enlarged cross-sectional view of a connecting portion between the high voltage power supply terminal and the connector, which is surrounded by a broken line III of FIG. 1.

As shown in FIG. 2, the high voltage power supply terminal 12 according to the embodiment is equipped with the high pressure power supply cable 12*c*, and an insulated holder 12*b*, the IC tag 13 which is a memory unit, an elastic sheet 12*d* which fixes the IC tag 13 thereto, and a shield material 12*f*, and a high frequency current absorber 12*e* (12*e*-1, 12*e*-2, and 12*e*-3) to which the shield material 12*f* are attached.

A plug 12*a* is provided at an end of the high voltage power supply cable 12*c* and the other end thereof is connected to one of the external leads 1*g* of the excimer lamp shown in FIG. 1. Such a high voltage power supply cable 12*c* is integrally provided with the insulated holder 12*b* by inserting the one end of the cable 12*c* at which the plug 12*a* is provided, in the insulated holder 12*b*, so that the tip of plug 12*a* may project from the insulated holder 12*b*. A connection binder 12*g* is attached to the insulated holder 12*b*, and as shown in FIG. 3, the high voltage power supply cable 12*c* is connected to a connection binder 11*a* of the connector 11 through the connection binder 12*g*.

The insulated holder 12*b* has a sufficient inner space to contain the IC tag 13 while the high voltage power supply cable 12*c* is inserted and passed therethrough. Moreover, since the case shown in FIG. 1 is in general made of metal such as stainless steel, in order that insulation between the case 10 and the plug 12*a* may be secured, the insulated holder 12*b* is made from material having the relative permittivity of 4.0% or less such as metal oxides, such as an alumina ($Al_2O_3$), or quartz glass ($SiO_2$), etc. Since the insulated holder 12*b* is made from insulator, such as an alumina, the heat insulation effect between the high voltage power supply cable 12*c* and the IC tag 13 is improved. The high frequency current absorber 12*e* has a high voltage power supply cable fixing section 12*e*-3 which has an opening for inserting the plug 12*a* of the high voltage power supply cable 12*c* thereinto; a high frequency current absorption section 12*e*-2 which is arranged between the high voltage power supply cable 12*c* and the IC tag 13, and which absorbs the high frequency current generated around the high voltage power supply cable 12*c* by excimer discharge; and an IC tag fixing section 12*e*-1 to which the elastic sheet 12*d* (brought in contact with one end of the IC tag 13) is pressed, in which the shield material 12*f* made of aluminum, nickel, etc. is provided on the surface of the IC tag side of the high-frequency-current absorption section 12*e*-2.

The IC tag 13 is installed in the inner space of the insulated holder 12*b*, and an end thereof is pressed to the high frequency current absorber 12*e* by one of elastic sheets 12*d* which are made from silicone rubber or fluorine system rubber (elastomer), and the other end of the IC tag 13 is pressed against the inner wall of the insulated electrode holder 12*b* by the other elastic sheet 12*d*, so as to be fixed thereto. Furthermore, in the example of FIGS. 2 and 3, there are a gap between the high voltage power supply cable 12*c* and the high frequency current absorber 12*e* and a gap between the IC tag 13 and the high frequency current absorber 12*e*. Only one gap may exist either between the high voltage power supply cable 12*c* and the high frequency current absorber 12*e* or between the IC tag 13 and the high frequency current absorber 12*e*.

Although the high frequency current absorber 12*e* is integrally formed as a unit as shown in the example of FIGS. 2 and 3, it may comprises two or more components. Such high frequency current material is made from material in which imaginary part $\mu''$ of complex permeability ($\mu=\mu'-j\mu''$) thereof is 1.0 or more, for example, magnetic substance material such as a ferrite, soft magnetism metal, carbonyl iron, and a permalloy etc. The spinel type ferrite which is a kind of a ferrite, expressed by chemical-formula $MeO.Fe_2O_3$ (Me: Ni, Mn, Zn, Cu, Mg), and has the spinel crystal structure.

Moreover, a high frequency current absorber may be made from low dielectric constant material, such as a SiOC film and an organic polymer film.

Since the noise generated from the high voltage power supply cable is about 600 MHZ in the case of the excimer lamp according the embodiment, a good high frequency current absorption property can be acquired by changing imaginary part of complex permeability or more into 1.0. From such a viewpoint, it is desirable that the high frequency current absorber made of silicone and carbonyl iron may be used.

The electromagnetic wave which enters from a side of the high voltage power supply cable 12*c* to the high frequency current absorber 12*e* exponentially causes attenuation loss until it reaches shield material 12*f*, and the wave is completely reflected by the shield material 12*f*. The reflected wave decreases similarly until it reaches the surface of the high frequency current absorber 12*e*, and turns into a transmitted wave and a secondary reflected wave on the surface, and this process is repeated. Therefore, it is possible to prevent the electromagnetic wave generated around the electric supply cable 12*c* of the excimer lamp from reaching the IC tag 13. By such a structure of the high voltage power supply terminal 12, even if high frequency current is generated from the high voltage power supply cable 12*c* when the excimer electric discharge takes place, high frequency current (noise) is absorbed as mentioned above by the high frequency current absorber 12*e* having the high complex permeability, which is provided between the high voltage power supply cable 12*c* and the IC tag 13, so that it is possible to prevent the noise from reaching the IC tag 13. That is, when such a high frequency current absorber 12*e* is not provided, there is a possibility that the IC tag 13 malfunctions due to the influence of the noise generated at the time of excimer electric discharge, but since the IC tag 13 is protected from the noise by the above-mentioned structure, it is possible to certainly prevent such a problem. And since there are the high frequency current absorber 12*e* and the gap between the high voltage power supply cable 12*c* and the IC tag 13, the effect of reducing the intensity of the electric field applied to the IC tag 13 becomes more remarkable.

Moreover, since the thermal resistance between the high voltage power supply cable 12*c* and the IC tag 13 becomes still higher by arranging the high frequency current absorber 12*e* between them, the heat insulation effect becomes remarkable.

By inserting the high voltage power supply terminal 12 shown in FIG. 2 in the connection binder 11*a* of the connector 11 which is provided on the case 10 as shown in FIG. 3, the terminal is connected to the high frequency lighting power supply (not shown), and the high pressure/high frequency voltage is supplied to the electrodes of the excimer lamp 1. The antenna 14 for transmitting and receiving data with the IC tag 13 is inserted in the connector 11, and this antenna is connected to the transceiver device (a reader/writer) which is not illustrated. No metallic case exist between the 1C tag 13 and the antenna 14 when the connector made from material such as resin, which does not have a problem in propagation of electric wave is used and the antenna 14 is attached to the connector since the metal case 10 has a cut-out portion at the attachment portion of the connector 11, so that it is possible to transmit and receive data between the IC tag 13 and an antenna 14, without any problem.

Figure 4:
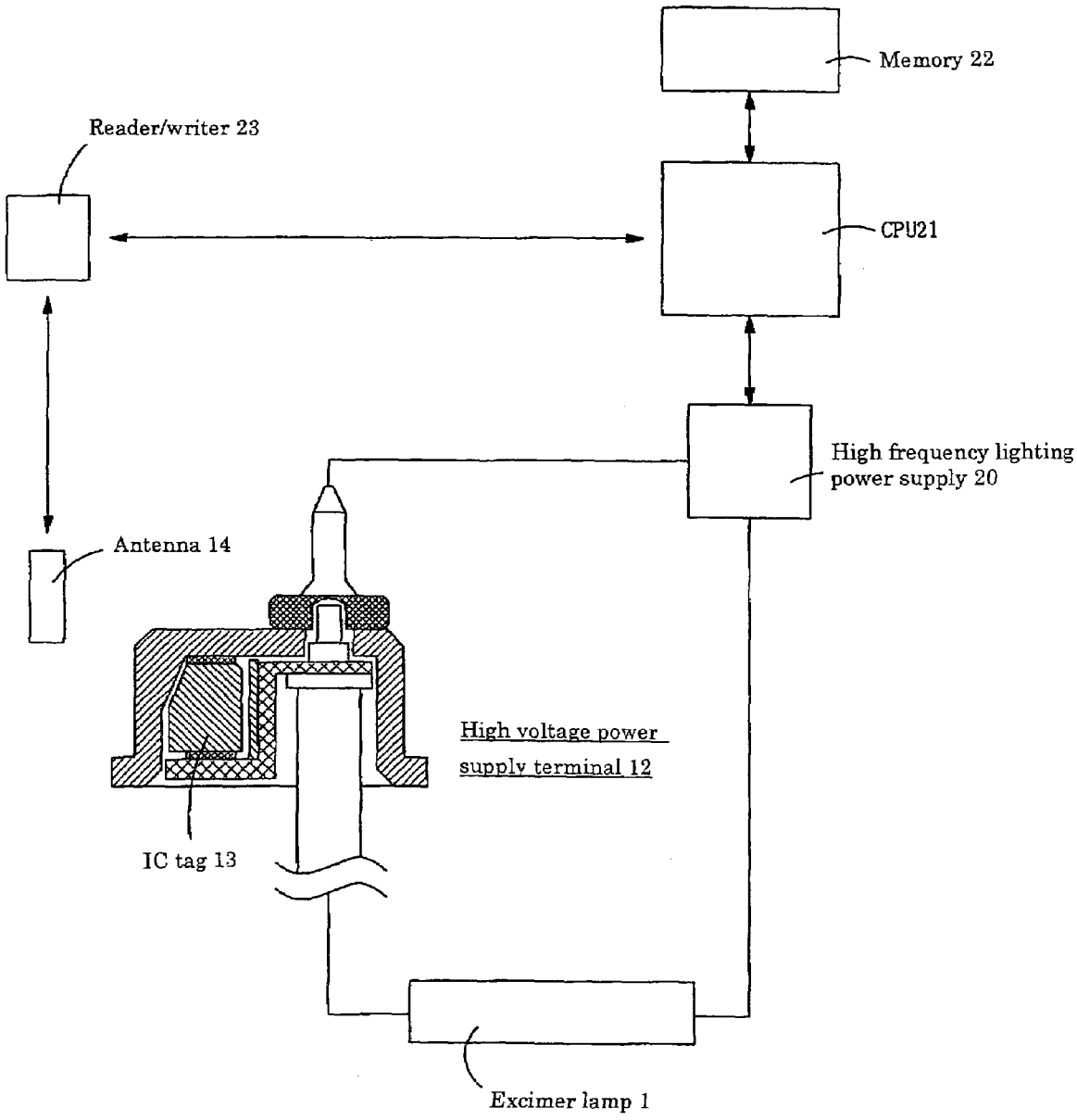
FIG. 4 is a conceptual diagram showing an example of the structure of a control system which controls lighting of an excimer lamp according to the present invention.

FIG. 4 is a schematic diagram showing a structural example of a control system which controls lighting of an excimer lamp according to an embodiment.

The high voltage power supply terminal 12 connected to the electrodes of the excimer lamp 1 is connected through the connector 11 (not shown in FIG. 4) to the high frequency lighting power supply 20, in which the excimer lamp 1 is turned on by supplying high voltage/high-frequency voltage from the high frequency lighting power supply 20 thereto. As described above, the antenna 14 is provided in the connector 11, and the antenna 14 is connected to the reader/writer 23 for writing or reading out data of the IC tag 13.

A CPU 21 controls the reader/writer 23 so as to write data in the IC tag 13, or read out data from the IC tag 13, and controls the high frequency lighting power supply 20, and controls lighting of a lamp 1.

In addition, although only one excimer lamp is shown in FIG. 4, two or more of the excimer lamps 1 may be provided as described above, and in such a case, the electric supply terminal 12, the IC tag 13, and the antenna 14 are provided respectively, and the CPU 21 controls lighting for the plurality of lamps as shown in FIG. 4.

An example of lighting control of the excimer lamp using the information memorized in the IC tag is explained below referring to FIG. 4.

Before the lighting of the excimer lamp 1 starts, the integral lighting time information which is updated up to the time of the last use and memorized in the IC tag 13 is read out through the antenna from the IC tag by the reader/writer 23, and this information is stored in the memory 22 connected to the CPU 21. The life span information peculiar to each excimer lamp 1 is also memorized in the IC tag 13. The CPU 21 checks whether the integral lighting time read from the IC tag 13 is less than the life span of each of the lamp, and when the integral lighting time is less than the life span, a lighting signal is transmitted from the CPU 21 to the high frequency lighting power supply 20. Thereby, the high frequency lighting power supply 20 supplies high voltage/high frequency voltage to the excimer lamps 1, so that the excimer lamps 1 are turned on.

The latest lighting time information of each lamp is added to the integral lighting time stored in the memory 22 on an as needed basis during lighting of the excimer lamps 1. And if an integral lighting time of any one of the lamp reaches the life span, the CPU 21 will transmit a lighting stop signal to the high frequency lighting power supply 20, and switches off the excimer lamps 1. Moreover, when the excimer lamp is switched off before an integral lighting time reaches the life span, the latest lighting time information is added to the integral lighting time information stored by the memory 22 immediately after the excimer lamp is turned off, and the latest integral lighting time information is stored in the IC tag 13 through the antenna by the reader/writer 23. By carrying out the above control, it is possible to efficiently manage the excimer lamp integral lighting time information for each excimer lamp.

Although in the above embodiments, the lighting of the excimer lamp is controlled by using the integral lighting time information updated up to the time of the last use stored in IC tag 13, for example, the illuminance property information stored in the IC tag 13 of each excimer lamp may be used, so that various control is possible using the information in the IC tag. For example, the illuminance of two or more excimer lamps may be controlled so as to be uniform, or supply of high frequency voltage may be controlled by using the load property information stored in the IC tag 13, so that abnormal electric discharge is not generated in each excimer lamp 1.

Figure 5:
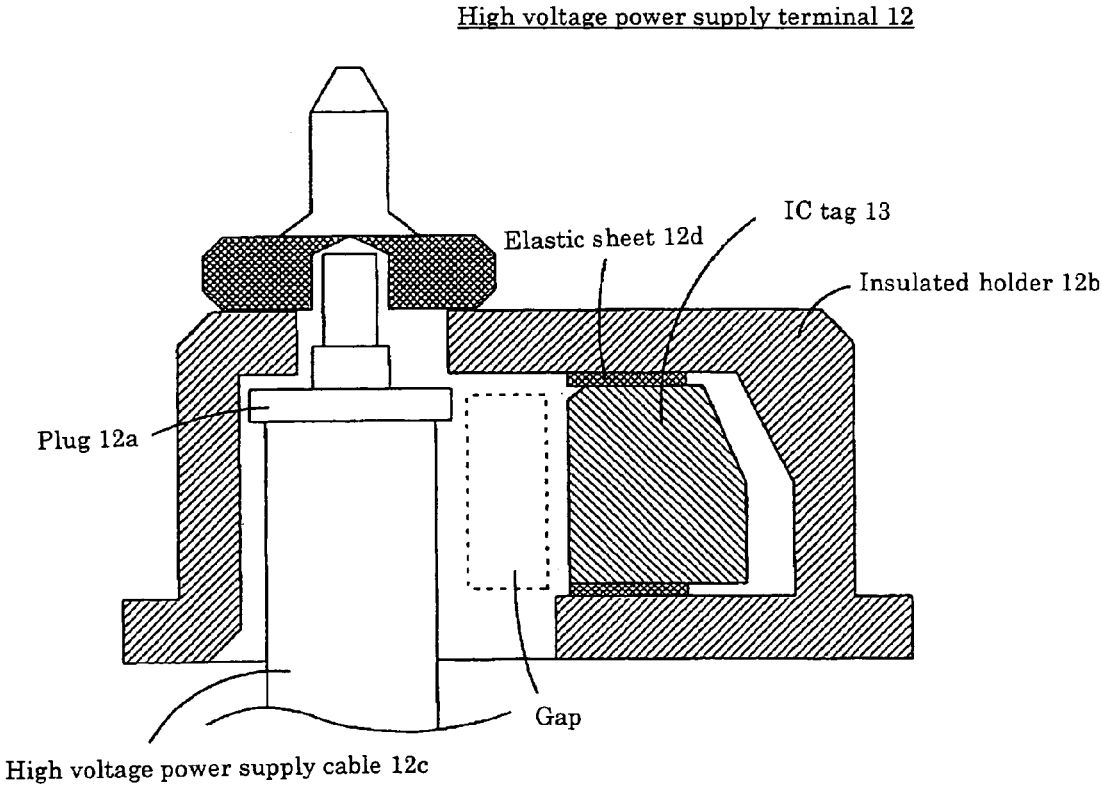
FIG. 5 is an enlarged view of a high voltage power supply terminal according to a second embodiment of the present invention.

FIG. 5 is an enlarged high voltage power supply terminal of a second embodiment.

The high voltage power supply terminal 12 is equipped with the high voltage power supply cable 12*c*, the insulated holder 12*b*, the IC tag 13 that is a memory unit, and the elastic sheet 12*d* which holds the IC tag 13. The plug 12*a* is provided in an end of the high voltage power supply cable 12*c*, and the other end of the high voltage power supply cable 12*c* is connected to the external lead 1*g* of the excimer lamp 1 shown in FIG. 1. Such a high voltage power supply cable 12*c* is integrally provided with the insulated material 12*b* by inserting the one end thereof at which the plug 12*a* is provided, in the inner space of the insulated holder 12*b*, so that the tip of plug 12*a* may project from the insulated holder 12*b*.

In the first embodiment, although the high frequency current absorber 12*e* is used, in this embodiment, the (air) gap is provided between the IC tag 13 and the high voltage power supply cable 12*c*.

Even in such a structure, since the air having a low dielectric constant is provided between the high voltage power supply cable and the IC tag 13, so that a potential slope becomes small, and the intensity of the electric field applied to the IC tag itself can be reduced.

Therefore, as in the first embodiment, it is possible to prevent the IC tag 13 from malfunctioning due to a noise.

Moreover, since the thermal resistance between the high voltage power supply cable 12*c* and the IC tag 13 becomes high when such a gap is provided therebetween, when high frequency voltage is impressed to the electrode of the excimer lamps 1, the IC tag 13 can be protected from the heat generated around the high voltage power supply cable 12*c*. As for the size of such a gap, it is desirable that the high frequency voltage supplied to the electrodes of the excimer lamp 1 shown in FIG. 1 be 2 kV-20 kV, the shortest distance at which an arbitrary point on the surface of the high voltage power supply cable 12*c* and an arbitrary point on the surface of the IC tag 13 are connected, be 1.5 mm or more when frequency is 40 kHZ-100 kH, and the maximum field strength applied to the IC tag be 25 V/mm or less.

In addition, it is desirable for the shortest distance to be 3.2 mm or more, when a gap and a high frequency current absorber 12*e* is provided, as shown in FIG. 2, and further, it is desirable that a gap be 1.3 mm or more.

Figure 6:
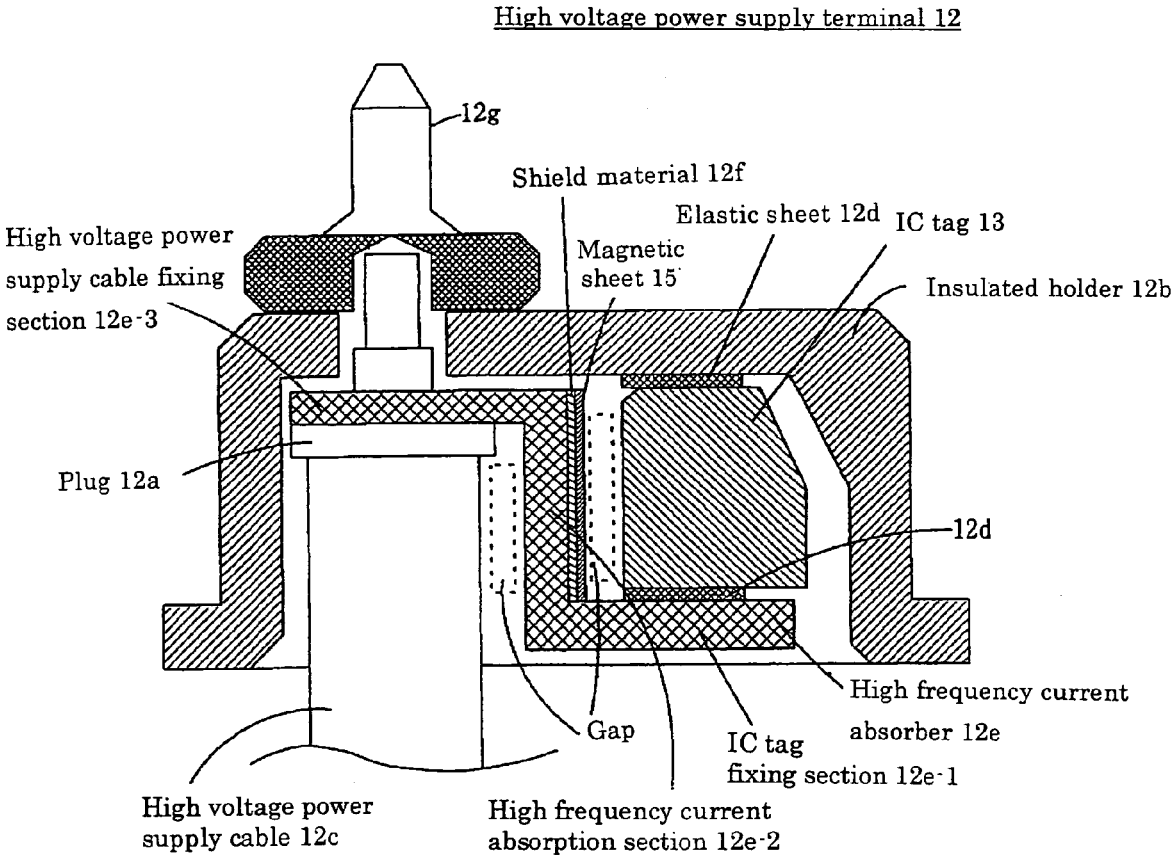
FIG. 6 is an enlarged view of a high voltage power supply terminal according to a third embodiment of the present invention.

FIG. 6 is an enlarged view of the high voltage power supply terminal 12 according a third embodiment.

In this embodiment, in the high voltage supply terminal 12, in addition to the shield material 12*f*, a magnetic sheet 15 is provided on the surface on the IC tag side of the high frequency current absorption section 12*e*-2. The magnetic sheet 15 is a thin magnetic sheet for improving wireless communications between the IC tag 13 and the antenna 14 near the metal case side. This magnetic sheet 15 has the magnetic substance which has complex permeability with low imaginary part and high real part. If a metal exists near the IC tag 13, an eddy current will occur in this metal at the time of communication, and a magnetic field required for communication is canceled, but a communication property is improved by providing the magnetic substance which has high complex permeability with low imaginary part and high real part as mentioned above. That is, magnetic flux is concentrated on the magnetic sheet 15, since the real part of the complex permeability of the magnetic sheet 15 is high. The magnetic flux flows without magnetic loss since imaginary part is low. For this reason, good communication is attained even if the IC tag 13 is installed near the metal case side.

The preceding description has been presented only to illustrate and describe exemplary embodiments of the excimer lamp and ultraviolet-rays irradiation apparatus according to the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An excimer lamp which has an arc tube made of dielectric materials capable of transmitting ultraviolet rays, and is filled up with electric discharge material in its inner space, a pair of electrodes facing each other through the dielectric materials forming the arc tube, and a high voltage power supply terminal for supplying high voltage to the electrodes through a high voltage power supply cable, the excimer lamp comprising:

an insulated holder provided in the high voltage power supply terminal, wherein the insulated holder has an inner space and the high voltage power supply cable connected to a connector for electric supply is inserted in the insulated holder, and an IC tag, wherein a gap is provided between the high voltage power supply cable and the IC tag.

2. The excimer lamp according to claim 1, further including a high frequency current absorber provided between the high voltage supply cable and the IC tag, and a shield material provided on an IC tag side surface of the high frequency current absorber.

3. The excimer lamp according to claim 2, wherein imaginary part ($\mu''$) of complex permeability ($\mu=\mu'-j\mu''$) of the high frequency current absorber into is 1.0 or more.

4. The excimer lamp according to claim 3, further including a magnetic sheet which has the high complex permeability with high real part and low imaginary part on the IC tag side of the high frequency current absorber.

5. The excimer lamp according to claim 1, wherein the insulated holder is made from an insulator having relative permittivity of 4.0 or less.

6. The excimer lamp according to claim 1, wherein the insulated holder is made of a metal oxide or quartz glass.

7. An ultraviolet-ray emitting apparatus comprising:

an excimer lamp having an arc tube made from dielectric material capable of transmission of ultraviolet-ray, a pair of electrodes which face each other through the dielectric material, a high voltage power supply terminal including an insulated holder having an inner space, which supply high voltage to the pair of electrodes through a high voltage power supply cable, wherein the high voltage power supply cable to be connected to a power supply connector is inserted in the high voltage power supply terminal;

a metallic case having a light emitting window from which light from the excimer lamp is emitted outside thereof;

a connector member which is proved on the case, is made of material capable of transmission of electric wave, and supplies high voltage to the high voltage power supply terminal of the excimer lamp, an IC tag is arranged in the inner space wherein a gap is provided between the high voltage power supply cable and the IC tag; and an antenna which carries out transmission or reception of information with the IC tag.

8. An excimer lamp apparatus comprising:

an arc tube made from dielectric material;

a pair of electrodes which face each other through the dielectric material, a high voltage power supply cable;

a high voltage power supply terminal including an insulated holder, which supplies high voltage to the pair of electrodes through a high voltage power supply cable, wherein the insulated holder has an inner space and the high voltage power supply cable connected to a connector for electric supply is inserted in the insulated holder; and an IC tag, wherein a gap is provided between the high voltage power supply cable and the IC tag.

9. The excimer lamp apparatus according to claim 8, wherein the IC tag is held by the insulated holder through an elastic sheet.

10. The excimer lamp apparatus according to claim 8, further including a high frequency current absorber.

11. The excimer lamp apparatus according to claim 10, wherein the IC tag is held between the insulated holder and the high frequency current absorber.

12. The excimer lamp apparatus according to claim 8, further including an antenna which receives and sends information to the IC tag, a memory which stores the excimer lamp information, and a CPU is configured to store the excimer lamp information in the memory and the IC tag.

13. The excimer lamp apparatus according to claim 8, wherein the IC tag and the high voltage power supply cable are provided as a unit.

14. The excimer lamp apparatus according to claim 10, wherein the high frequency current absorber has an IC tag fixing section, a high frequency current absorption section which is located between the high voltage power supply cable and the IC tag, and high voltage power supply cable fixing section.

15. The excimer lamp apparatus according to claim 14, wherein the voltage power supply cable fixing section has an opening for inserting a plug of the high voltage power supply cable.

16. The excimer lamp apparatus according to claim 15, wherein a shield material is provided on an IC tag side surface of the high frequency current absorber section.

17. The excimer lamp apparatus according to claim 16, wherein the shield metal is made of aluminum, or nickel.

18. The excimer lamp apparatus according to claim 14, wherein an elastic sheet is pressed to the IC tag fixing section.

* * * * *